US007320668B1

(12) United States Patent
Warder

(10) Patent No.: US 7,320,668 B1
(45) Date of Patent: Jan. 22, 2008

(54) WHOLE BODY MASSAGE TOOL THAT UTILIZES GRAVITY FOR ENERGY

(76) Inventor: Gary R. Warder, 2041 Camino Rainbow, Fallbrook, CA (US) 92028

( * ) Notice: Subject to any disclaimer, the term of this patent is extended or adjusted under 35 U.S.C. 154(b) by 271 days.

(21) Appl. No.: 10/454,393

(22) Filed: Jun. 3, 2003

Related U.S. Application Data

(60) Provisional application No. 60/386,130, filed on Jun. 5, 2002.

(51) Int. Cl.
*A61H 7/10* (2006.01)

(52) U.S. Cl. ..... 601/136; 606/204

(58) Field of Classification Search ..... D24/200, D24/211; 601/24, 84, 115, 49, 128–130, 601/133–137; 606/204, 135; 482/148, 91
See application file for complete search history.

(56) References Cited

U.S. PATENT DOCUMENTS

| | | | | |
|---|---|---|---|---|
| 1,265,083 | A * | 5/1918 | Hoard | 601/118 |
| 4,126,129 | A | 11/1978 | Rainbow | 128/67 |
| 4,452,237 | A | 6/1984 | Lewis | 601/134 |
| 4,662,363 | A | 5/1987 | Romano et al. | 601/134 |
| 5,024,215 | A * | 6/1991 | Wang | 606/241 |
| 5,348,529 | A | 9/1994 | Veltri | 601/99 |
| 5,843,005 | A | 12/1998 | Chubinsky | 601/15 |
| 5,868,689 | A * | 2/1999 | Faroky et al. | 601/120 |
| 5,899,868 | A * | 5/1999 | VandeBerg | 601/134 |
| 5,913,839 | A * | 6/1999 | Wincek | 601/134 |
| 5,938,684 | A | 8/1999 | Lynch et al. | 606/204 |
| 6,010,469 | A | 1/2000 | McAtee | 601/135 |
| 6,013,042 | A * | 1/2000 | Sakai | 601/134 |
| 6,146,343 | A | 11/2000 | Stewart | 601/118 |
| 6,217,121 | B1 * | 4/2001 | Mollet | 297/452.28 |
| 6,241,694 | B1 | 6/2001 | Goulding-Thompson et al. | 601/135 |
| 6,283,929 | B1 | 9/2001 | Mjehovic | 601/136 |
| 6,821,260 | B2 * | 11/2004 | Fors | 601/133 |
| 2002/0049469 | A1 * | 4/2002 | Chang | 606/204 |
| 2002/0068888 | A1 * | 6/2002 | Wang et al. | 601/136 |

* cited by examiner

*Primary Examiner*—AnhTuan T. Nguyen
*Assistant Examiner*—Tuan Van Nguyen
(74) *Attorney, Agent, or Firm*—Knobbe Martens Olson & Bear LLP

(57) ABSTRACT

This invention is a whole body massage tool with a base to support one or more uprights, which can be set in a multiplicity of configurations to provide adjustability whether intended use is for the body surface muscles or to reach muscles deep within the body structure. Embodiments of the self-massage tool provide a new and improved method of administering therapeutic pressure to the muscles of the body, utilizing gravity or body weight for energy. This invention is used for liberating muscles of pain, fear and memories (i.e. stress).

4 Claims, 6 Drawing Sheets

WHOLE BODY MASSAGE TOOL THAT UTILIZES GRAVITY FOR ENERGY

REFERENCE TO RELATED APPLICATIONS

This application claims the benefit of priority under 35 U.S.C. § 119(e) of U.S. Provisional Application No. 60/386,130 filed on 2002 Jun. 5 and entitled Whole body self-massage tool that utilizes gravity for energy, the entirety of which is incorporated herein by reference.

FIELD OF THE INVENTION

The present invention relates generally to the field of massage tools, and, more specifically, this invention relates to a self massage apparatus.

This invention was created out of the need for a versatile, economical, multi faceted, all-purpose efficient bodywork tool for effective self-massage for the entire body or to use as an aid for physical therapists, personal trainers and massage technicians, for healing and ridding the body of muscular stress, utilizing body weight and gravity for energy.

BACKGROUND

Description of Prior Art

Most prior art in the field of massage tools are electric, hand held or mounted on a wall for use. Prior art that is electric or battery operated cost money to operate. They are limited in scope wherein generally the user cannot apply pressure while using. This type of apparatus may only be used to work on the surface area of muscles; many problems are deep within the muscles. They may be uncomfortable to use and cannot be used on many areas of the body. Hand held devices are limited in use wherein the user needs to exert energy to apply and may get tired in a short period of time. The user cannot physically apply enough pressure for many applications. Many areas of the body cannot be reached by hand or may be uncomfortable to use. By being hand held, prior art may be insufficient and has the disadvantage of tension placed on one set of muscles to relax another set of muscles. Any prior art massage tool that is mounted on a wall is limited in use. They cannot be moved or used on many areas of the body.

The ancient and modern Toltecs practice recapitulation through the art of dreaming and various other techniques to induce awareness and healing. Trauma and injuries, as well as fear from the past or of the future create stress and affect the physical form, using up valuable energy to keep muscles tight that would be more beneficial to us if they were supple and relaxed. Recapitulation is what takes place when one re-examines his or her life experiences by bringing attention to an area of distress. The Toltec methods are time consuming and involve esoteric practices and techniques that may take years to learn.

Juxtaposed to conventional massage whereby another party supplies the therapy, the amount of pressure and the sustaining power may be overdone or insufficient, not to mention expensive. Applying pressure with ones hand or using one set of muscles to relax another is tiresome and inefficient. An insufficient means in that the pressure to expend is limited in depth penetration and intensity of pressure and the energy necessary to do so in such a manner is limited whether using fingers or a hand held device to apply pressure.

Objects and Advantages

The object of this tool is to provide a means for anyone to apply therapeutic pressure to any part of the body bringing the users attention to any area, making it easy to focus on the problem area and sustain the pressure needed to get in touch with and resolve a physical health issue, while reducing stress and pain from the muscles of the entire body.

With the embodiments of this invention the user is in complete control of where, when and how much pressure is applied using his or her body weight to lean, press, sit, lay, or rest on the knob end, with any part of the body, for deep tissue/muscle self-massage therapy. The steady pressure induces any muscle that is being pressed on to release the energy that is trapped there, removing the remnants of the past that are causing pain thereby relaxing the stressed muscle.

Recapitulation in a physical manner, applying pressure to bring the attention to a troubled area is a simple and direct method that anyone can perform immediately without special training or esoteric knowledge.

Converse to the disadvantages of prior art, the user of this invention:

- Does not get tired using embodiments of the tool by having to hold the device to apply pressure; using one set of muscles to relax another muscle, as in prior art patent #'s US006010469A & US006241694B1. User of this tool can be comfortably relaxed while utilizing body weight and gravity for energy, to focus on and remove pain from the body, gaining revitalization and recapturing lost energy being consumed by tight or distressed muscles.
- Embodiments of the massage tool is more versatile than prior art such as patent # U.S. Pat. No. 5,843,005 whereby the user can adjust height of extensions or extended upright(s), the longer the bolt or upright, the deeper the penetration level capability.
- Can set the width of extensions when using more than one upright, adjusting for any particular area of the body, such as a wide setting for working both shoulders at the same time or a close setting for working the muscles located on both sides of the spine on back and neck among other multiplicity of possibilities, providing the user with options for any situation.
- Can have a choice of knob end member for pressure intensity diversity.
- Allows the user the advantage of working muscles close to the bone as for hands, feet, face and scalp as well as being beneficial for fleshy body parts such as abdomen, upper legs and buttocks. Prior art devices are only used for a specific body area as seen in prior art patent #'s U.S. Pat. No. 4,126,129, U.S. Pat. No. 4,662,363 and U.S. Pat. No. 6,146,343.
- Embodiments of the massage tool are not limited to a specific body area but can be used for the entire body.
- Embodiments of the massage tool can be moveable and portable or fixed, embodied as a chair or other furniture. Prior Art, U.S. Pat. No. 4,452,237 needs to be mounted on a wall and US1992000972996 uses a rocking motion whereas with embodiments of this invention, no rollers or rocking motion are necessary.

Embodiments of the whole body self massage tool:

- Can be used in a vertical, horizontal or in a slanted position.
- Offers the user a choice of penetration levels and pressure diversity.

Provides a new understanding of how the body works, the cause and effect of the discomfort and a therapeutic remedy for pain.

Provides an advantage whereby the user can relax while applying pressure utilizing gravity and the users body weight distribution for energy to work on any part of the body.

Can benefit anyone and can easily be used by people with physical infirmity, children and the elderly Can be used while holding, resting, leaning, laying or sitting on it.

Aids in eliminating the causes of stress that manifests as tight sore muscle tissue. When pressed upon these muscles begin to relax, reducing stress and pain.

Expands field of motion and freedom of movement.

Improves the physical condition of the body.

Has the advantage of operating hands free and gives the user the freedom to do something else while massaging a body area such as simultaneously working, reading, writing, playing a game or watching T.V.

Other objects and advantages comprise: injury rehabilitation, aids in the repair of internal conflicts, improves bodily system functions, revitalizes and gives the user an energy boost.

Further objects and advantages of embodiments of this invention:

To reduce health care expenses.

To become self sufficient in repairing our own physical infirmities.

To reduce time off work and improve productivity.

For a no cost fitness program available to everyone.

For a tool that is easy to use, portable and economical to produce.

For a tool to apply pressure to any part of the body in an effortless and relaxed manner.

Requires no special skills to operate.

Further Objects and Advantages of embodiments of this invention will become apparent from a consideration of the drawings and ensuing description.

SUMMARY

This apparatus is a do-it-yourself bodywork massage tool for applying focused, sustained pressure to any part of the body, utilizing gravity or body weight for energy, to remove pain, fear and memories from the muscles of the body.

As is common knowledge, many health problems are 'stress related'. Stress is stored in muscles of the body. Embodiments of the massage tool are designed to relieve the muscles of this stress in such a way that the user does not become tired or use energy to apply therapeutic pressure, as prior art requires.

The invention disclosed herein provides an improved way to remove stress by controlling and manipulating ones attention for the purpose of healing the physical body. No special knowledge or skills are necessary to use and benefit from this tool.

Spontaneous recapitulation occurs when one uses this tool to remove the pain, fear and memories from the muscles of the body in a simple and direct manner. Juxtaposed to the Toltecs' psychological methods of recapitulation this invention provides the user with the means to heal via recapitulation in a physiological manner.

The user can heal an area by pressing where the pain or discomfort is, thus bringing their attention to the area of the old injury, tight, distressed muscle, or problem area thereby increasing circulation, blood flow, providing nourishment and unblocking a stagnant energy flow. The more a user works with the tool to relax the muscles of the body, the more freely the energy can flow through and around the body.

Chi is another name for the energy that healing arts refer to in the practice and teachings of: acupressure, acupuncture, shiatsu, tai chi, yoga, Trigger point therapy and Rolfing. This energy is also known as kath or kundalini. Martial artists also work to improve the flow of this energy by using other various techniques to increase the flow of this energy thereby perfecting the body.

Embodiments of the massage tool can provide a superior means whereby the user can apply therapeutic pressure easily to stimulate any specific body area for a more rapid recovery, utilizing gravity and body weight for energy.

Embodiments of the massage tool can be used for minutes or hours without the user becoming fatigued and can reach areas not ordinarily reachable with hands or prior art. Benefits of this invention are an improved field of motion, restoration of natural body functions and realignment of the body to its natural state of health and balance for optimum physical condition and performance.

Use of this invention is not limited to a specific body area, but can be successfully used on muscles of the entire body.

For purposes of summarizing embodiments of the invention, certain aspects, advantages, and novel features of the invention have been described herein. It is to be understood that not necessarily all such aspects, advantages, or novel features will be embodied in any particular embodiment of the invention.

DRAWING FIGURES

Many aspects of the embodiments of the massage tool can be better understood with reference to the following drawings. The components in the drawings are not necessarily to scale, emphasis instead being placed upon clearly illustrating the principals of this invention. Moreover, in the drawings, like reference numerals designate corresponding parts throughout the several views. Embodiments of the massage tool are described in more detail with reference to accompanying drawings in which:

FIG. 1 is a view of component parts that can be used for assembling the various configurations for use in embodiments as illustrated in FIGS. 3, 4, 5, 19, 20 and 21.

FIG. 2 is one embodiment of a framework or base of the tool and is depicted as a flat rectangular plastic board having one or more holes. In FIG. 2 it is shown with round holes. In other embodiments the hole(s) could be a slot, square or any other suitably shaped aperture.

REFERENCE NUMERALS TO DRAWINGS

Figure 1:
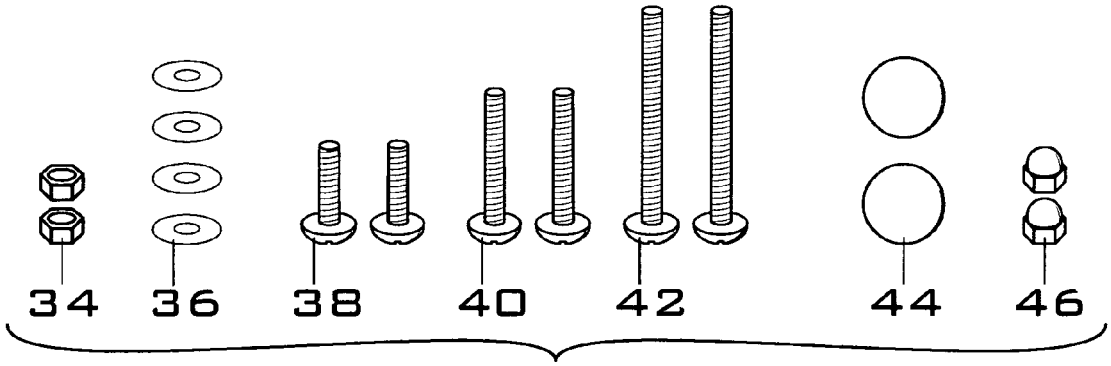

| | | | |
|---|---|---|---|
| 30 | base | 32 | hole |
| 34 | nut | 36 | washer |
| 38 | upright shaft, short | 40 | upright shaft medium |
| 42 | upright shaft tong | 44 | large knob end member |
| 46 | small knob end member | 48 | body part |
| 50 | massage tool | 52 | handle |
| 54 | modular hardware upright member | 56 | integral upright member |
| 58 | manufactured upright member with interchangeable knob end members | 60 | integral tool |
| 62 | female threaded hole to accept male threaded upright | 64 | modular tool |
| | | 66 | manufactured tool |

DETAILED DESCRIPTION

Embodiments of the whole body self massage tool provide an apparatus for administering therapeutic focused sustained pressure to any point or to any specific area of the entire body utilizing body weight and gravity for energy.

Embodiments of the massage tool brings the attention to an area and enables the user to sustain pressure in a relaxed manner to a body area for administering self-massage without getting tired.

Embodiments of the massage tool also provide the user a hands free method giving freedom to do something else while massaging the body simultaneously. The massage tool accomplishes this by providing a portable, adjustable, interchangeable assembling of component parts that comprise: a base, upright member(s) and knob end member(s) and will be described in greater detail herein.

The following is a discussion and description of several embodiments of the tool, such being made with reference to the drawings, wherein the same reference numerals are used to indicate the same or similar parts and/or structure. It should be noted that such discussion and description is not meant to unduly limit the scope of the invention.

Figure 20:
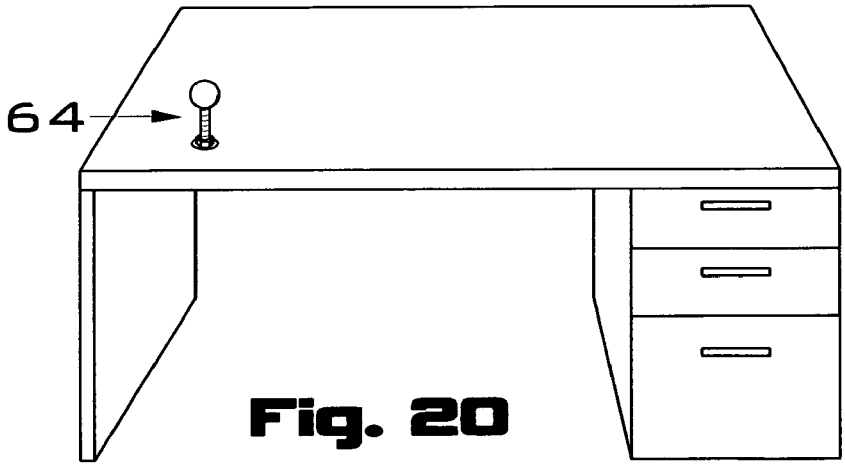
FIG. 20 is one embodiment illustrated as being incorporated with a desk or tabletop as the base of the tool.
Figure 21:
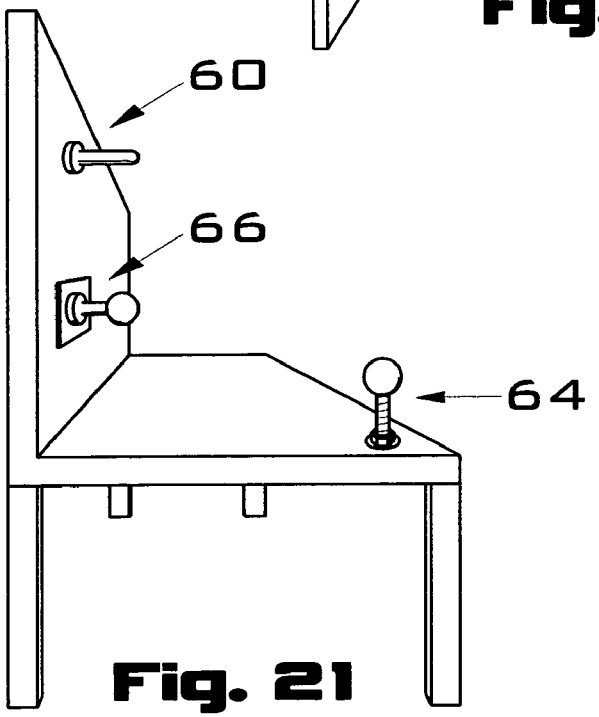
FIG. 21 shows three alternative embodiments of the massage tool using a park bench as a base whereby Ref. Nos. 60,64,66 represent three embodiments of the tool.

Embodiments of the massage tool's base, framework, or structure may be constructed from a variety of suitable natural or man made materials such as plastic, polymer, metal, wood, fiberglass or rubber that is strong enough to support upright member(s) when in use. The base 30 can be of any suitable size. The base 30 can have many shapes including but not limited to oval, circular, triangular or any regular or irregular shape. The surface base of the tool may be flat, concave or convex. The base may have one or more holes. The hole(s) may be round, square, a slot or any other shape that is suitable, for matching uprights. The base 30 of the tool may be of any color. The massage tool may be embodied with a small base size such as but not limited to a 6" circle with only one hole to accommodate the attachment of any suitable length upright that extends from said base, with or without interchangeable knob ends. Another embodiment may have a framework or structure such as embodied as a chair 50. The chair represents the tool's base as described with reference to FIG. 19, or as a desk or table as shown in FIG. 20 or as a bench as illustrated in FIG. 21, or as any other suitable furniture. Upright members may be built integral with the base or may be as a modular attachment. Uprights may be used singularly or in plurality and may be placed in a multitude of configurations. The length of upright used and size and shape of the knob end member(s) may vary depending on the amount of pressure to be applied and choice of depth penetration lever desired for any particular application.

Figure 5:
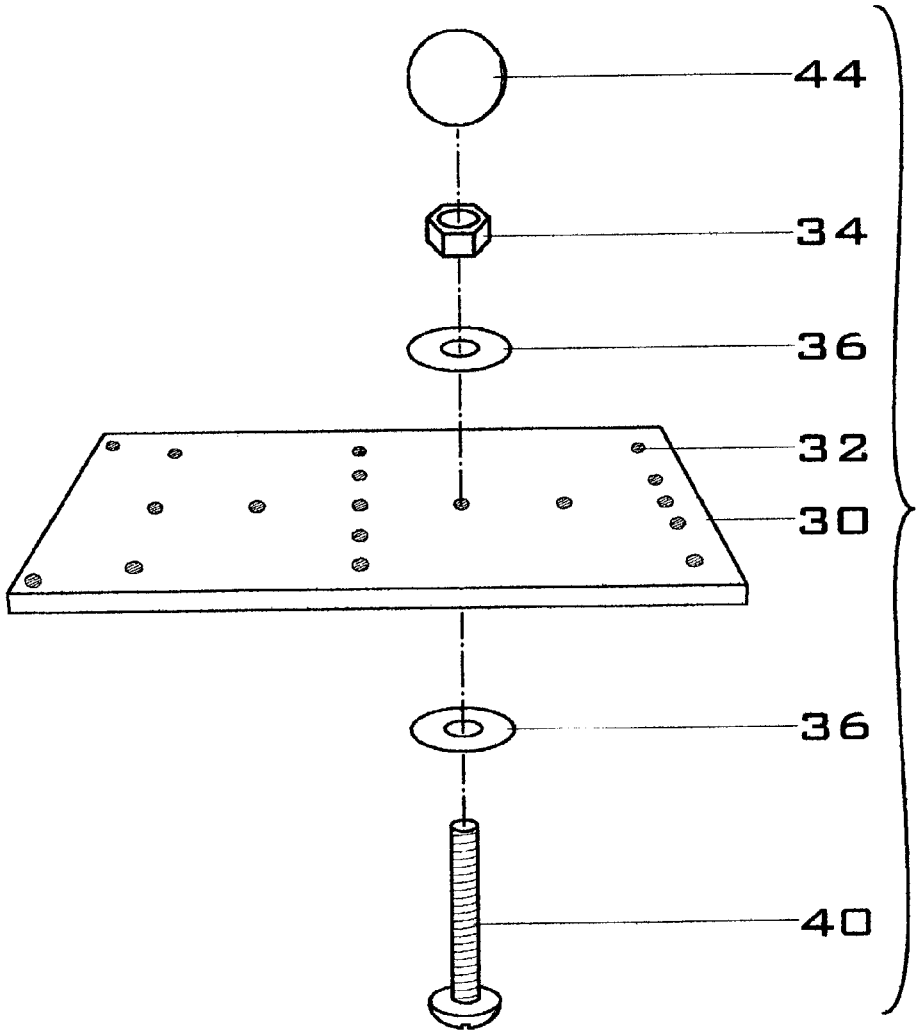
FIG. 5 is an exploded view of one embodiment to show placement of the component parts in one of many possible configurations.
Figure 17:
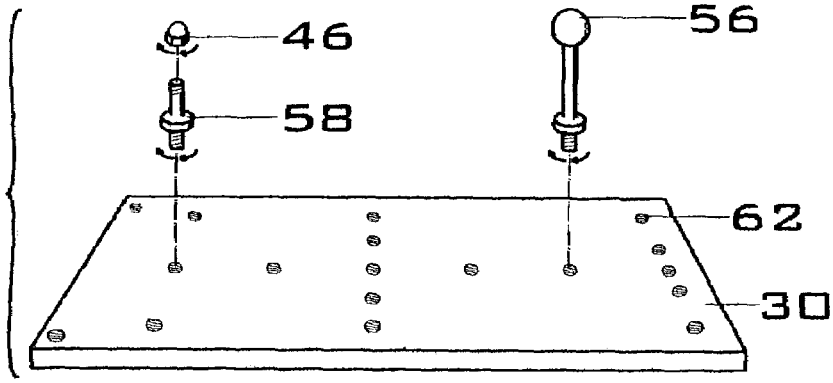
FIG. 17 is a view showing two embodiments of upright members

An upright shaft member 38,40,42,54,56,58,60 can be of any suitable length, wide enough to give support and constructed from any suitable natural or man-made material. Upright members may be as an integral upright shaft and knob end member 56, or may be an upright shaft with separate and interchangeable knob end(s) 44,46. An upright is that which extends perpendicular to the base 30 or at an angle to the base if base surface is concave or convex. Uprights may be integral with the base 60 or otherwise fixed to base, or may be modular and removably attached to the base 30 as illustrated in FIGS. 5 and 17 for examples. An upright 54,56,58 can be a simple set of hardware as illustrated in FIG. 1 or may be otherwise constructed or manufactured, with or without interchangeable knob ends.

Knob end members may be rounded 44, 46 or of any other shape and size that is suitable for massage therapy. Knob end members may be made of hard or semi-hard material and of any color. Knob end members are attached to upright by means of a matching thread or may be attached in another secure manner.

FIG. 1 illustrates a view in one embodiment of upright members shown as an assortment of component parts to be assembled that can be but are not limited to upright members in which the component parts are common hardware. The component parts represented are threaded bolts of various lengths on which to screw on choice of rounded, threaded knob end(s) with washers and a nut to secure in place for use. The view of component parts illustrated in FIG. 1 comprise:

2-2" bolts, ⅜"×16 tpi
2-3.5" bolts, ⅜"×16 tpi
2-5" bolts, ⅜"×16 tpi
4 washers
2 nuts
2 small rounded ½" diameter knob end members
2 larger rounded 1⅜" diameter knob end members In one embodiment a modular upright may be assembled using the above component parts as shown in the exploded view in FIG. 5, using an upright shaft represented here as bolts (with a choice of three lengths), flat washers and a nut to secure in place for use.

Figure 2:
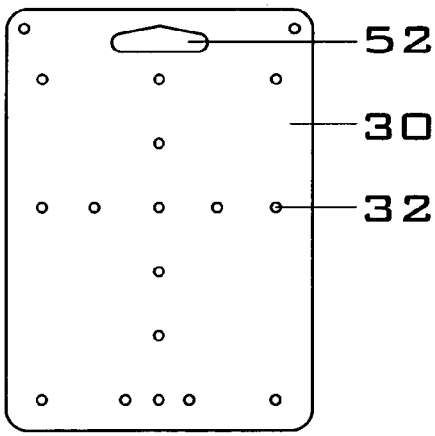

FIG. 2 illustrates one embodiment of a tool base component measuring 14"L×10"W×⅜"D, with an 18-hole design, strategically placed to facilitate the attachment of removable upright components. The holes in FIG. 2 are round. In other embodiments the hole could be a slot, square or any other suitable shape to match the upright that is attached. The amount of holes and their placement may vary. The holes may be used for the placement of perpendicular, removably connectable component parts, to accept body conformations of men, women and children by providing a multitude of possible arrangements. The view from the top of the base and the view from the bottom of the base are the same; therefore, FIG. 2 represents the view from the top and the bottom of the base in one embodiment. In one embodiment the tool may have a cutout handle for holding, carrying or hanging on a wall. The massage tool 50 in this embodiment is shown with removably connectable upright component parts as illustrated in FIG. 1, and is attached to the massage tool's base 30 by inserting upright(s) though a hole 32 prepared appropriately in the massage tool's base 30 and that which provides the user a variety of possible settings.

Figure 3:
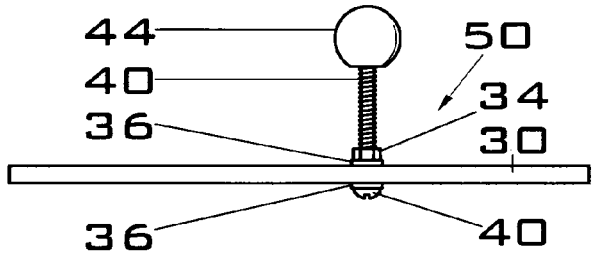
FIG. 3 is a side view showing one embodiment of the invention in one configuration

FIG. 3 is a side view of the massage tool in one embodiment and illustrates one of many possible arrangements and comprises: one base 30, one upright shaft 40, two washers 36, one nut 34 and one rounded knob end member 44. The basic components of the massage tool are shown in place and ready for use.

Figure 4:
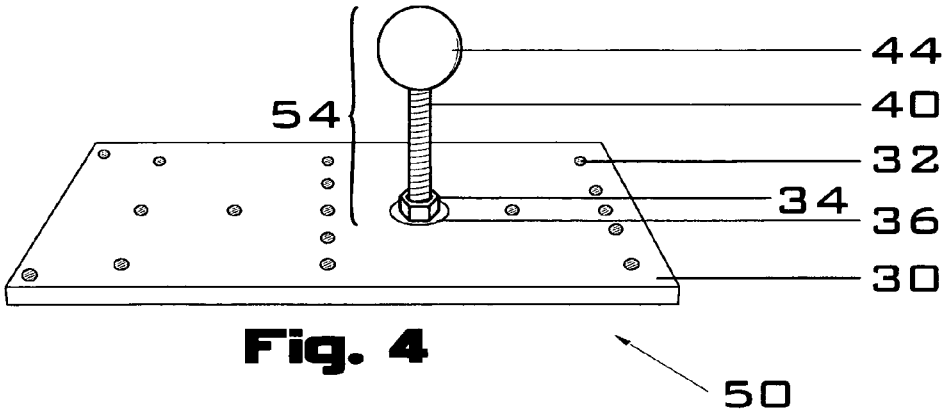
FIG. 4 is a top perspective view of the one embodiment

FIG. 4 is a top perspective view of one embodiment showing a base with modular component parts 54 attached and ready for use. Embodiments of the massage tool 50 may be used in a vertical, horizontal or slanted position.

FIG. 5 is an exploded view of one embodiment to show the placement of the component parts. The method of assembling these component parts is as follows:

1) Choose bolt size

2) Place 1 washer down on bolt shaft

3) Place bolt w/washer through selected hole in base from the bottom through to the top surface extending above the base.

4) Add the other washer to the top surface of the base.

5) Add nut, screw down & tighten

Figure 6:
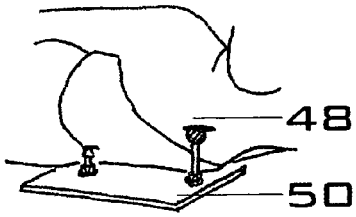
FIGS. 6-15 are drawings of one embodiment of this invention illustrating how the tool may be used on various parts of the body, utilizing gravity for energy.

6) Use coin, key or screwdriver to hold slot in bolt while tightening nut with wrench or pliers until firm 7) Choose large or small knob and place at end of bolt, tighten snugly 8) Reverse process described in steps 1-7 to remove bolt FIGS. 6-15 illustrate the use of one embodiment of the whole body self-massage tool, showing a variety of possible tool positions FIG. 6 is a view of the massage tool in one embodiment showing the user controlling the amount of pressure by rolling onto uprights, massaging or working on the muscles of the chest and abdomen. Medium length upright shaft 40 and large a round knob end member 44 is being used to massage chest and a short length upright shaft 38 and a small rounded knob end member 46 is being used to simultaneously massage the abdomen area.

Figure 7:
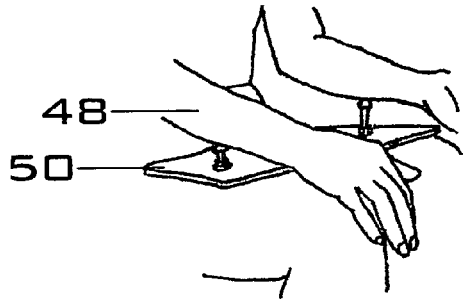

FIG. 7 is a view of the massage tool in one embodiment showing use of the tool utilizing two small upright shafts 38 with small knob ends 46 attached, utilizing weight of arms to apply pressure to muscles of forearms, front and back of lower arms. This position and setting is also effective for use on hands.

Figure 8:
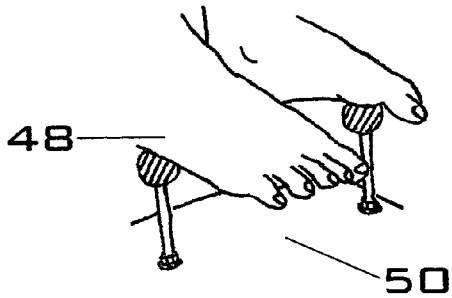

FIG. 8 is a view of the massage tool in one embodiment showing use of the tool on the feet utilizing medium length upright shaft members 40 and large knob ends 44. Utilizing weight of feet and legs to apply pressure to soles of feet. Any size upright or knob ends will be effective in this position. More pressure can be applied by simply leaning forward.

Figure 9:
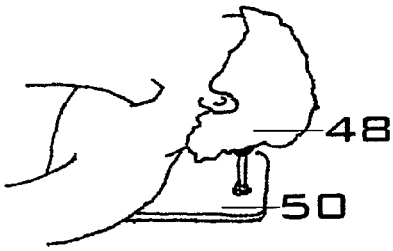

FIG. 9 is a view of the massage tool in one embodiment showing use of the tool while lying down, massaging the back of the head, using weight of head to apply focused sustained pressure, hands free. A medium upright 40 and large knob end 44 are shown in this reference and can be comfortably used in this arrangement on all areas of the back as well as turning over and working on the side, or front of the body. Enough pressure is easily applied by utilizing the weight of the body part, which lies upon the upright members 54,56,58.

Figure 10:
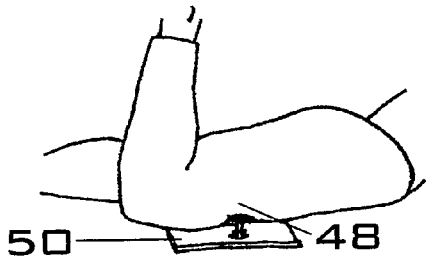

FIG. 10 is a view of the massage tool in one embodiment showing use of the tool while lying down with tool placed under upper thigh. A more intense pressure is being applied simply by lifting leg, bending at knee. Any arrangement or choice of upright(s) can be used, working one or both legs at the same time. A short upright 54 with large knob end 44 is illustrated here.

Figure 11:
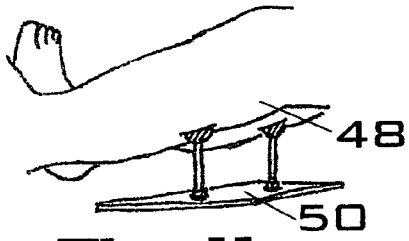

FIG. 11 is a view of the massage tool in one embodiment showing use of the tool on the back of lower legs. Long upright shafts 42 with large knob ends 44 are shown and can be applied in this configuration while sitting or lying down.

Figure 12:
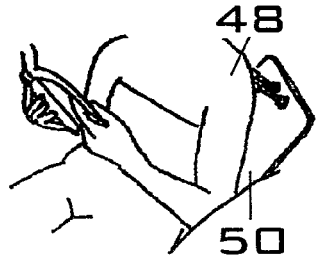

FIG. 12 is a view of the massage tool in one embodiment showing use of the tool while sitting in a chair, reading. Therapeutic pressure is being applied to shoulder area by leaning into extended upright shaft members 54; body weight and gravity do all the work. Shown are medium length uprights 40 with small knob ends 46.

Figure 13:
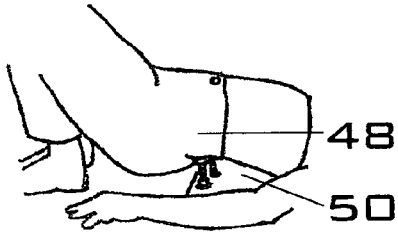

FIG. 13 is a view of the massage tool in one embodiment showing use of the tool applying pressure to the lower back area utilizing the longer length upright 42 and large knob ends 44 resting on side and leaning into uprights 54 adjusting pressure by raising and lowering hips, while lying on a couch, bed or floor.

Figure 14:
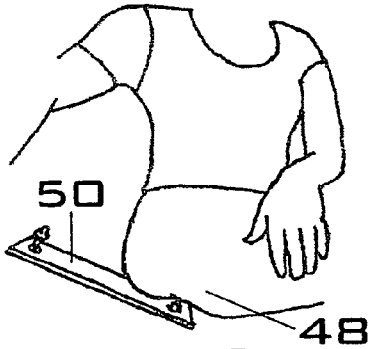

FIG. 14 is a view of the massage tool in one embodiment showing use of the tool utilizing body weight and gravity to apply pressure to hip and buttock muscles. Short upright 38 is used with a small knob end 46 to pin point target area.

Figure 15:
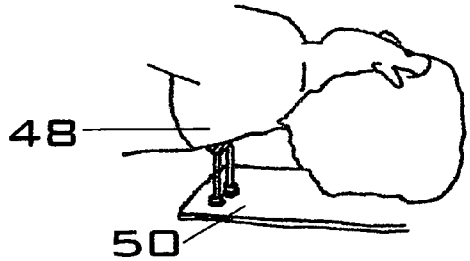
Figure 16:
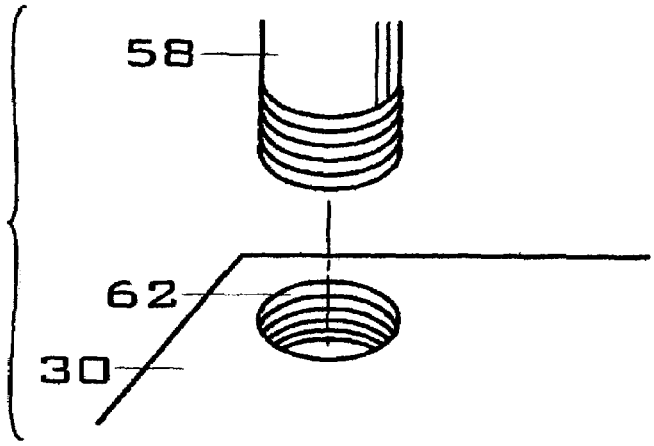
FIG. 16 is a view in one embodiment of a base aperture to illustrate one method of attaching upright whereby the base has a female thread and the upright has a matching male thread.

FIG. 15 is a view of the massage tool in one embodiment showing use of the tool on upper back with upright members in one of many possible configurations. Medium upright members 54 are being used in this illustration FIG. 16 is a view of integral upright members 56 in embodiments whereby the shaft and knob ends are one piece. They are shown here with two different size knob ends. An upright component can be of any length or width and can have any size or shaped head or knob end that is suitable for massage therapy. The examples shown here have one upright member with a large ball shaped knob end and also shown is an integral upright member 56 with a small dome shaped knob end.

FIG. 17 is a view, which illustrates one upright member embodied as an integral upright 56 and one upright member in another embodiment and that, which has an interchangeable knob end. Both views are prepared with a threaded end to twist or screw into the matching threaded base aperture 64. The lengths of uprights and choice of knob end(s) used may vary depending on the body area and amount of depth penetration necessary for an effective application.

Figure 18:
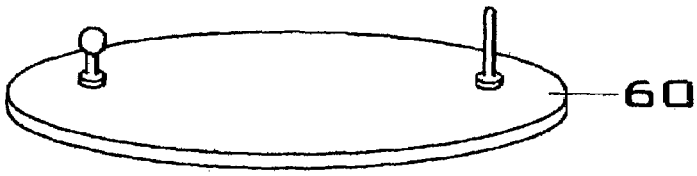
FIG. 18 is one embodiment whereby the base and upright are integral, as in one piece, and may be embodied with or without interchangeable knob end members.

FIG. 18 is another embodiment whereby the base of the tool and upright(s) are integral. Size and shape may vary depending on intended use. This embodiment of the tool is convenient with no interchangeable component parts.

Figure 19:
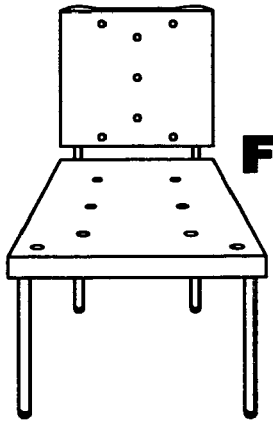
FIG. 19 is one embodiment showing the massage tool base as a chair.

FIG. 19 is another embodiment in which the base of the tool may be a chair. The illustration shows a chair with a plurality of holes to facilitate removable uprights at any desired position as needed to apply pressure to the body while sitting. Component part(s) may be modular, integral to chair or may be an integral upright and that which twists, screws or snaps or otherwise is secured to the base.

FIG. 20 is another embodiment in which the base of the tool is represented as a table or desk. Uprights may be modular or integral upright members or may be integral to base.

FIG. 21 illustrates three embodiments represented by using a bench as a tool base 30 and shown as Ref. Nos. 64,66, and 60 and is described below. Another embodiment may have a single tool as in any of the three massage tools depicted. The same principal can be applied to an office chair or another structure as a base in other embodiments. These variations can be easily installed and is not limited to, a park or bus stop bench, waiting room chairs for convenience and use by the general public.

Ref. No. 66 illustrates a manufactured tool attached permanently or removable attached by using a separate plate or base to adhere securely to a park or bus stop bench.

Ref. No. 60 Illustrates a massage tool built into or integral to a bench.

Ref. No. 64 illustrates modular components parts or that which can be an integral upright, attached to a bench. By utilizing the bench as a base for the massage tool and can be made available for public access as a means of relaxation and physical fitness conditioning.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

OPERATION

In operation one uses the whole body massage tool as is shown in one embodiment as illustrated in FIGS. 3-5 and as described further in FIGS. 6-15 by placing the massage tool on a support surface such as chair, couch, bed or floor. The user can place any body area or any specific point onto the tool's upright knob end member(s) supported by a base that can be adjusted to provide many possible arrangements. The user can massage a body area utilizing body weight and gravity simply by sitting, laying, leaning, resting on the knob ends of the tool, pressing the chosen area, applying as much pressure as needed to bring attention to the area allowing the user the ability to apply a sustained focused pressure, for as long as they want, without getting tired.

Too much pressure will put more fear and pain into the area rather than dissipating it. Utilizing gravity and body-weight, increasing or decreasing pressure when needed by raising or lowering body part, or by extending, rotating, stretching, bending or otherwise moving the muscles of the interrelated body parts, surrounding the area of choice.

The Illustrated views further show the portable versatility of this massage tool by placing it on the users lap and working on arms by simply resting arm(s) on the tool's knob end. The weight of the body part and gravity do all the work, pressure being applied naturally with little effort under these conditions, making it easy to massage any part of the body. Other convenient applications of use with embodiments of the tool on lap, while user is comfortably sitting, can be by placing the uprights facing down to work on front of thighs or up for working on either the front or back of the lower arms or hands front and back, or positioned with uprights facing toward stomach or chest area or face, leaning in a direction such as forward in these applications, to apply more pressure as needed.

Placing chosen configuration of the tool in contact with any desired area or adjacent to the location of the greatest concentration of pain, the user actively presses against or by remaining still, resting or leaning on tool's knob end members, intermittently adjusting the tool to the body, or body to the tool, conforming to the contours of the body.

Embodiments of the present invention accomplishes this by providing interchangeable adjustable arrangements for assembling of the attachable component parts, removably mounted to the base of the tool. These uprights are available to use 1 or more at a time. The small knob provides a more concentrated focus and can penetrate deeper with less pressure. Longer bolts may be used for different situations, positions and parts of the body. It provides the user the ability to reach deeper penetration levels for hard to get to areas and/or enhances the gravity pull by providing the user more natural pressure to a body part of less weight and mass.

Drawings on pages are represented by FIGS. 6-15 and illustrate the use of the whole body self-massage tool in a variety of positions to aid in the understanding of how to use the massage tool for the entire body.

In operation the integral uprights as illustrated in FIG. 16 serve the same purpose of versatility as the modular uprights that comprise component parts whereby uprights are interchangeable for versatility. The integral uprights can have interchangeable knob end members and can be attached to base as shown in FIG. 17 by twisting upright into the matching thread until a tight secure position is reached.

Similarly, the massage tool can be embodied as a chair (FIG. 19) with a pattern of holes in the seat and back for placement of uprights. In this embodiment the user need only sit back leaning onto the upright(s) working on the muscles of the back, upper arms and sides of torso if sitting on the chair sideways or by sitting on top of the upright(s) when placed on seat area to work on buttocks or back of upper legs. This tool can also be used for other body areas by placing body part such as lower legs, arms and feet onto the upright(s) that have been securely attached to the base of tool as represented by the seat area of the chair and by placing said chair near another chair or a couch that the user can be seated on using the chair as a separate tool in the same manner as other embodiments, to apply pressure.

The massage tool embodied as a desk or table as shown in FIG. 20 or as a bench as shown in FIG. 21 use the same method of operation as the previously mentioned embodiments with the exception of going to the tool as opposed to bringing the tool to the user.

A successful treatment can take just a few minutes or may require an hour or longer, depending upon the particular condition causing the pain or discomfort and its severity.

CONCLUSION, RAMIFICATIONS, AND SCOPE

Accordingly the reader will see that this invention provides a highly reliable, versatile, adjustable, economical whole body massage tool that can be used by virtually all ages and all levels of fitness to restore and maintain a healthy pain free body. This tool can be used in public areas or in the privacy and comfort of your home. The tool will not wear out, does not have to be hand held or mounted, is non-electric and provides a no cost physical fitness aid that can be used while doing something else. For example, the tool can be used while simultaneously working on a computer, at a desk, while reading, watching T.V., while sewing or writing. With a design that offers the user a wide range of possibilities for use on the entire body.

In addition, this is a revolutionary approach to anti-aging and longevity. It is the process of going to, unlocking, releasing and thereby removing stress from the muscles of the body. Use of the tool relaxes strained, overworked, hard tight muscles and returns the muscles to a soft and supple state, maximizing strength, flexibility and durability for a physical fitness program without rigorous exercise. It may have taken years of stress buildup for a condition to occur and manifest, therefore, it may require repeated treatments to eliminate the cause of the pain or discomfort or to alleviate the ailment. This tool is convenient and easy to use.

Furthermore, the massage tool has the additional advantages in that

- It provides the user a choice of penetration levels and pressure diversity
- It allows the user an expansive choice of positioning the tool to body. A tool that can be used in a vertical, horizontal or slanted position. The user simply holds, rests upon, leans into, lays or sits on the tools knob end(s) for fast and lasting relief
- It provides the advantage whereby the user can relax while applying pressure, utilizing gravity and the users body weight for energy to work on any part of the body
- It provides an aid to discovering and eliminating the causes of stress manifested as tight sore muscle tissue or discomfort. When pressed upon these muscles begin to relax, reducing stress and pain. Depending on the severity of the ailment it may take repeated treatments to eliminate the cause completely.
- It allows the user a means to become self sufficient in repairing and improving their own body conditions from the top of the head to the bottom of the feet
- It provides a tool that is easy to use, portable or fixed and economical to produce
- It allows the user to fully massage his or her body without the cost of hiring a specialist
- It provides an aid for masseurs, personal trainers and physical therapists to better assist their customers or patients by directing them on how to use the tool, saving the instructor from exerting their own energy to apply therapeutic pressure. And also for the caregiver to use on him or herself as much repetition and overuse of their own muscles are used in applying a healing treatment or deep tissue massage therapy to another person. The caregiver can then assist more than one person simultaneously.

Although the description above contains many specificities, these should not be construed as limiting the scope of the invention but as merely providing illustrations of some of the possible embodiments.

Embodiments of the massage tool can benefit anyone who works at a desk, table, on a production line, or anyone who does any type of repetitious work. Benefits include relief from back and neck aches, arm and hand pain, whereby user can periodically or continuously massage any pertinent body part by placing affected area on said tool to relieve stress and relax overworked or strained muscles.

Embodiments of the massage tool can benefit the general public whereby anyone can have access to the tool which has been installed on park benches, or on any suitably equipped chair available in any waiting room such as public bus, train or airport terminals. Embodiments of the massage tool can be used for relaxing the muscles of the body. For people of all ages, to improve their physical condition while they are waiting.

Embodiments of the massage tool has the advantage of operating hands-free and allows the user freedom to continue working, reading, writing or playing a game while healing their aching back, as one example.

Embodiments of the massage tool can benefit students by having the tool available in lunchrooms or as a physical fitness aid at the gym. The tool can be used for general muscle relaxation or to use on strained or pulled muscles as a result of workouts, sports, yoga or any other physical activity.

Embodiments of the massage tool can benefit dancers and athletes. The tool can increase circulation in any body area, where muscles may be tight, knotted or out of condition and aid in the removal of stress from the muscles of the body while improving their mobility and flexibility. Stress can be caused by over extending, over exercising, over exerting the muscles of the body. This tool aids in building muscular strength and increases muscle stamina. Can be used for all levels of fitness.

Embodiments of the massage tool will help people who walk, run or are on their feet for long periods, to use for tired feet, one can simply rest the bottom of feet on the knob end(s). Gravity and body weight do all the work, moving body part intermediately and applying healing pressure to any area for relief.

Easy and convenient to use, this tool can be operated anytime, anywhere, and virtually by anyone for relief of muscular stress and pain.

As can be seen in the drawings this invention is easily adaptable to provide unlimited practical applications. The attachable or fixed uprights can be used singularly or in plurality.

The administration of therapeutic pressure is applied by resting any body part on tool's uprights knob end(s), or by actively pressing choice of body part against the respective knob end(s). The user directs and places knob end(s) as close to the center of the pain as possible, searching for painful areas, and holding the pressure at a point until the tension is relieved and the muscle relaxes. Actively pressing can be as simple as: while sitting, feet on tool's knob end(s), leaning torso forward toward feet. This provides more body weight thus more pressure being applied to any given area. The user is always in control of how much pressure is being applied.

Embodiments of the massage tool provides longer upright attachments or extensions and diversifies the tool's use to be effective in deep tissue areas. For example, this invention provides overweight people with a means to reach deep within the body to aid in the process of re-examination or the study their own personal history. Pressing on an area brings the users attention to that area, allowing the user to recapitulate and gain insight as to the cause of their distress, and permits the user to rid the body of the pain or problem area. This tool is an aid in relaxing stressed muscles, unblocking energy and built-up pressure to allow a more natural flow of energy to resume.

Embodiments of the massage tool supplies employers and corporate leaders with a means whereby they can drastically reduce health care cost by providing this tool to employees as a means of reducing stress or as an aid in repairing on the job or work related injuries or conditions. As a result the employee will take less time off work, become more efficient and alert without the distraction of discomfort, can repair maladies faster reducing recovery time, and provide an improved service and increased production in all areas, in any field, for healthier workers.

Physical injuries are common occurrences in everyday life. This invention provides relief for a multiplicity of conditions including, twists, strains, sprains, spasms, headaches, stomach aches, soreness, pain, cramps, pulled muscles, overworked muscles, stiffness, lumps, bumps and bruises. This tool can be used on the entire body and is a powerful, multi-faceted, energy efficient, stress eliminator for fast acting with long lasting results.

Embodiments of the massage tool can widely benefit all of mankind to aid in eliminating pain, poor posture and can be used for personal improvement. This tool can help people help themselves.

Embodiments of the massage tool offers the user the means to administer therapeutic pressure to any body area, or more than one body area simultaneously by simply resting or leaning on or into the knob ends of the tool to relieve stress that manifests in the muscles of the body. Losing fatigue and tiredness, relief of muscular tension, gaining balance, fluidity and alignment with a refreshing, revitalizing energy, in a short period of use time.

The user will gain a new understanding of how the body works and responds to attention and learn how to improve health and fitness with the least amount of effort or energy used.

There is no set of rules that apply, it us determined by the user how much pressure is sufficient and how long to stay focused at each point depending on sensitivity and the severity of the injury. The pressure may vary with the individual. Embodiments of the massage tool's design allows the user the ability to apply focused sustained pressure to any area of the body, utilizing gravity or body weight for energy. This was not possible with previous inventions.

Although the illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

What is claimed is:

1. A method for performing a deep self-massage of a specific area of a muscle or other body part, comprising:

providing an apparatus for deep self-massage that comprises: a substantially planar base member having an upper surface and a lower surface, the lower surface being configured to allow the substantially planar base member to lie on a substantially horizontal area of the ground, one or two knob end massaging members, each of the one or two knob end massaging members having a massaging surface, wherein at least a portion of the massaging surface is substantially hemispherical in shape, only one or two supporting uprights that extend perpendicularly from the upper surface of the substantially planar base member, each of the only one or two supporting uprights having a first end and a second end, wherein the first end of each of the only one or two supporting uprights contacts the substantially planar base member, wherein the second end of each of the only one or two supporting uprights firmly supports one of the one or two knob end massaging members such that the substantially hemispherical portion of the massaging surface of the one of the one or two knob end massaging members faces away from the upper surface of the substantially planar base member, wherein the second end of each of the only one or two supporting uprights further firmly supports the one of the one or two knob end massaging members such that the substantially hemispherical portion of the massaging surface of the one of the one or two knob end massaging members is supported by the supporting upright at a distance from the upper surface of the substantially planar base member, each of the only one or two supporting uprights having sufficient strength to maintain the distance of the substantially hemispherical portion of the massaging surface of the one of the one or two knob end massaging members from the upper surface of the substantially planar base member when a human rests the weight of his or her buttocks and accompanying body weight on the substantially hemispherical portion of the massaging surface of the knob end massaging member, and wherein at least one of the only one or two supporting uprights is sufficiently long to allow the substantially hemispherical portion of the massaging surface of the one of the one or two knob end massaging members to be pressed deeply into a large muscle;

positioning the apparatus for deep self-massage on the lap when in a seated position, such that the only one or two supporting uprights point substantially upwards from the upper surface of the substantially planar base member;

positioning the specific area of the muscle or other body part such that the specific area of the muscle or other body part contacts one or both of the one or two knob end massaging members;

leaning the upper body forward so as to increase pressure on the specific area of the muscle or other body part by the one or both of the one or two knob end massaging members; and allowing gravity and body weight to press the specific area of the muscle or other body part onto the one or both of the one or two knob end massaging members, whereby the specific area of the muscle or other body part is massaged and wherein the body part is at least one of the set consisting of: the abdomen, the chest, the shoulders, and the head.

2. The method of claim 1, further comprising:

providing a first supporting upright member and a second supporting upright member, wherein the first supporting upright member has a length that is greater than the length of the second supporting upright member; and using the first supporting upright member to support the knob end massaging member if a deeper massage is desired and using the second supporting upright member to support the knob end massaging member if a less deep massage is desired.

3. The method of claim 1, further comprising:

identifying a specific area of a muscle or other body part that is painful;

placing one of the one or two knob end massaging members as close as is possible to a center portion of the specific area of a muscle or other body part that is painful;

varying an angle of pressure of the one of the one or two knob end massaging member with respect to the specific area of a muscle or other body part that is painful in order to identify a point of the specific area of a muscle or other body part that is painful at which the pain is increased;

pressing the point of the specific area of a muscle or other body part that is painful at which the pain is increased until tension in the point of the specific area of a muscle or other body part that is painful at which the pain is increased is relieved and the specific area of a muscle or other body part relaxes.

4. The method of claim 3, further comprising:

bringing the attention to the specific area of the muscle or other body part being massaged; and bringing the attention to at least one of pain, fear, and memories associated with the specific area of the muscle or other body part.

* * * * *